US010969703B2

(12) United States Patent
Takeuchi et al.

(10) Patent No.: US 10,969,703 B2
(45) Date of Patent: Apr. 6, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Eileen Takeuchi, Tokyo (JP); Koichi Nakata, Tokyo (JP); Shubun Kujirai, Toride (JP); Haruki Mori, Ichikawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/731,150

(22) Filed: Dec. 31, 2019

(65) Prior Publication Data

US 2020/0218171 A1 Jul. 9, 2020

(30) Foreign Application Priority Data

Jan. 9, 2019 (JP) ..... JP2019-001948

(51) Int. Cl.

| | |
|---|---|
| ***G03G 5/00*** | (2006.01) |
| ***G03G 5/07*** | (2006.01) |
| ***G03G 15/02*** | (2006.01) |
| ***G03G 21/18*** | (2006.01) |
| ***G03G 15/06*** | (2006.01) |
| ***G03G 5/14*** | (2006.01) |
| ***G03G 5/147*** | (2006.01) |

(52) U.S. Cl.

CPC ..... *G03G 5/071* (2013.01); *G03G 5/142* (2013.01); *G03G 5/1476* (2013.01); *G03G 5/14756* (2013.01); *G03G 5/14769* (2013.01); *G03G 15/0233* (2013.01); *G03G 15/06* (2013.01); *G03G 21/18* (2013.01)

(58) Field of Classification Search

CPC ..... G03G 5/14756; G03G 5/1476; G03G 5/14769

USPC ..... 430/66

See application file for complete search history.

(56) References Cited

U.S. PATENT DOCUMENTS

| | | | |
|---|---|---|---|
| 7,186,489 | B2 | 3/2007 | Uematsu et al. |
| 7,226,711 | B2 | 6/2007 | Amamiya et al. |
| 7,534,534 | B2 | 5/2009 | Nakata et al. |
| 9,063,441 | B2 | 6/2015 | Yamanami et al. |
| 9,316,931 | B2 | 4/2016 | Takagi et al. |

(Continued)

FOREIGN PATENT DOCUMENTS

| | | |
|---|---|---|
| JP | 2001-166514 | 6/2001 |
| JP | 2006-065339 | 3/2006 |

(Continued)

OTHER PUBLICATIONS

U.S. Appl. No. 16/673,485, filed Nov. 4, 2019, Haruki Mori.

(Continued)

*Primary Examiner* — Mark A Chapman

(74) *Attorney, Agent, or Firm* — Venable LLP

(57) ABSTRACT

Provided is an electrophotographic photosensitive member including a surface layer containing: a copolymerization product of a composition containing a hole-transportable compound having a chain-polymerizable functional group and a compound having a specific structure; and metal oxide particles.

9 Claims, 2 Drawing Sheets

(56) References Cited

U.S. PATENT DOCUMENTS

| | | | | |
|---|---|---|---|---|
| 9,389,523 | B2 | 7/2016 | Nakata et al. | |
| 9,594,318 | B2 | 3/2017 | Nakata et al. | |
| 9,740,117 | B2 | 8/2017 | Kosaka et al. | |
| 10,042,272 | B2 | 8/2018 | Mori et al. | |
| 10,120,331 | B2 | 11/2018 | Nakata et al. | |
| 10,241,429 | B2 | 3/2019 | Shimada et al. | |
| 10,310,395 | B2 | 6/2019 | Nakata et al. | |
| 10,353,340 | B2 | 7/2019 | Kuroiwa et al. | |
| 10,365,569 | B2 | 7/2019 | Tokimitsu et al. | |
| 10,451,984 | B2 | 10/2019 | Mori et al. | |
| 10,488,769 | B2 | 11/2019 | Nakata et al. | |
| 10,488,770 | B2 | 11/2019 | Kuroiwa et al. | |
| 10,488,771 | B2 | 11/2019 | Mori et al. | |
| 10,558,132 | B2 | 2/2020 | Ishiduka et al. | |
| 10,558,133 | B2 | 2/2020 | Nakamura et al. | |
| 10,761,442 | B2 * | 9/2020 | Nakata | G03G 5/0607 |
| 2018/0314188 | A1 | 11/2018 | Takeuchi et al. | |
| 2018/0335708 | A1 | 11/2018 | Nakata et al. | |
| 2019/0361365 | A1 | 11/2019 | Mori et al. | |
| 2019/0369513 | A1 | 12/2019 | Ueno et al. | |
| 2019/0369514 | A1 | 12/2019 | Watanabe et al. | |
| 2019/0391504 | A1 | 12/2019 | Nakata et al. | |

FOREIGN PATENT DOCUMENTS

| | | |
|---|---|---|
| JP | 5046678 | 10/2012 |
| JP | 2014-085564 | 5/2014 |

OTHER PUBLICATIONS

U.S. Appl. No. 16/711,974, filed Dec. 12, 2019, Ryoichi Tokimitsu.
U.S. Appl. No. 16/777,173, filed Jan. 30, 2020, Koichi Nakata.
U.S. Appl. No. 16/832,508, filed Mar. 27, 2020, Eileen Takeuchi.
U.S. Appl. No. 16/855,022, filed Apr. 22, 2020, Kenichi Ikari.
U.S. Appl. No. 16/855,035, filed Apr. 22, 2020, Ryoichi Tokimitsu.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus each including the electrophotographic photosensitive member.

Description of the Related Art

As an electrophotographic photosensitive member to be mounted onto an electrophotographic apparatus, there is widely used an electrophotographic photosensitive member containing an organic photoconductive substance (charge-generating substance). In recent years, an improvement in mechanical durability (wear resistance) of the electrophotographic photosensitive member has been required for the purposes of lengthening the lifetime of the electrophotographic photosensitive member and improving image quality at the time of its repeated use.

As a technology for improving the wear resistance, there is given a method involving incorporating metal oxide particles into a surface layer of the electrophotographic photosensitive member. In Japanese Patent Application Laid-Open No. 2014-085564, there is a description of a technology for improving the wear resistance by incorporating two or more metal oxides having different primary particle diameters.

However, in the electrophotographic photosensitive member described in Japanese Patent Application Laid-Open No. 2014-085564, many hydroxy groups are present on surfaces of the metal oxide particles, and hence the surfaces have high hydrophilicity. Accordingly, although the electrophotographic photosensitive member having metal oxide particles dispersed in its surface layer exhibits excellent wear resistance, its photosensitive layer is penetrated by moisture. As a result, there is a problem in that the moisture content of the photosensitive layer changes through long-term repeated use, resulting in a fluctuation in potential of the electrophotographic photosensitive member. Particularly under a high-temperature and high-humidity environment, the potential fluctuation at the time of long-term repeated use is large, and hence there is room for improvement.

Therefore, an object of the present disclosure is to provide an electrophotographic photosensitive member including a surface layer suppressed in potential fluctuation at the time of long-term repeated use irrespective of an environment.

Another object of the present disclosure is to provide a process cartridge including the electrophotographic photosensitive member and an electrophotographic apparatus including the process cartridge.

SUMMARY OF THE INVENTION

The above-mentioned objects are achieved by the following present disclosure.

The present disclosure relates to an electrophotographic photosensitive member including in this order: an electroconductive support; a photosensitive layer; and a surface layer, wherein the surface layer contains: a copolymerization product of a composition containing a hole-transportable compound having a chain-polymerizable functional group and a compound represented by the formula (1); and metal oxide particles:

(1)

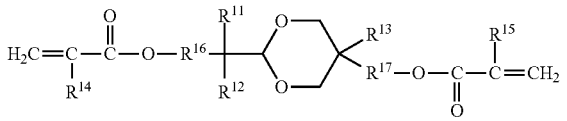

in the formula (1), $R^{11}$ and $R^{12}$ each independently represent an alkyl group having 1 or more and 4 or less carbon atoms, $R^{11}$ and $R^{12}$ may be bonded to each other to form a ring, $R^{13}$ represents an alkyl group having 1 or more and 4 or less carbon atoms, $R^{14}$ and $R^{15}$ each independently represent a hydrogen atom or a methyl group, and $R^{16}$ and $R^{17}$ each independently represent an alkylene group having 1 or more and 4 or less carbon atoms.

The present disclosure also relates to a process cartridge including: the electrophotographic photosensitive member; and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus.

The present disclosure also relates to an electrophotographic apparatus including: the electrophotographic photosensitive member; and at least one unit selected from the group consisting of a charging unit, an exposing unit, a developing unit, and a transferring unit.

Further features of the present invention will become apparent from the following description of exemplary embodiments with reference to the attached drawings.

DESCRIPTION OF THE EMBODIMENTS

Figure 1:
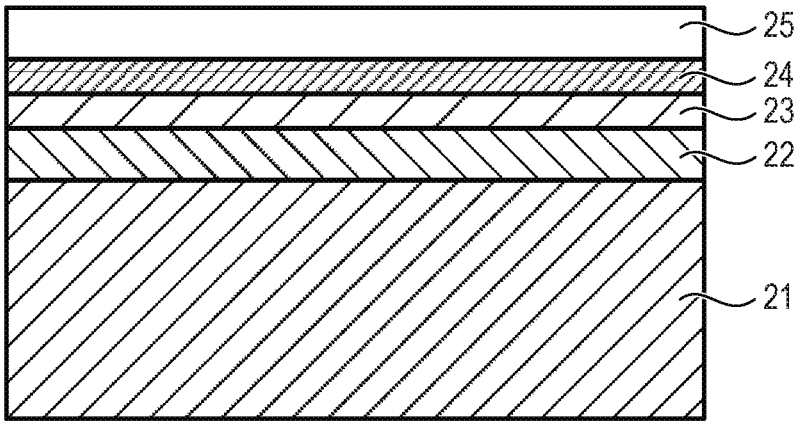
FIG. 1 is a schematic view for illustrating an example of the configuration of an electrophotographic photosensitive member according to at least one embodiment of the present disclosure.

The present disclosure relates to an electrophotographic photosensitive member including in this order: an electroconductive support; a photosensitive layer; and a surface layer, wherein the surface layer contains: a copolymerization product of a composition containing a hole-transportable compound having a chain-polymerizable functional group and a compound represented by the following formula (1); and metal oxide particles:

(1)

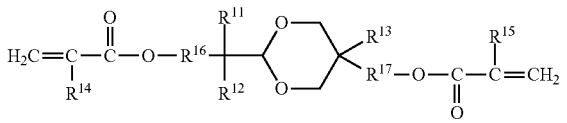

in the formula (1), $R^{11}$ and $R^{12}$ each independently represent an alkyl group having 1 or more and 4 or less carbon atoms, $R^{11}$ and $R^{12}$ may be bonded to each other to form a ring, $R^{13}$ represents an alkyl group having 1 or more and 4 or less carbon atoms, $R^{14}$ and $R^{15}$ each independently represent a hydrogen atom or a methyl group, and $R^{16}$ and $R^{17}$ each independently represent an alkylene group having 1 or more and 4 or less carbon atoms.

The inventors have made extensive investigations, and as a result, have found that, when the surface layer of an electrophotographic photosensitive member contains the copolymerization product of the composition containing the hole-transportable compound having a chain-polymerizable functional group and the compound represented by the formula (1), and the metal oxide particles, the electrophotographic photosensitive member has high durability while maintaining wear resistance, with the result that an electrophotographic photosensitive member suppressed in potential fluctuation at the time of long-term repeated use irrespective of an environment as compared to the related art is obtained.

The inventors presume as described below as to the reason why the electrophotographic photosensitive member according to at least one embodiment of the present disclosure is suppressed in potential fluctuation at the time of long-term repeated use irrespective of an environment.

When the surface layer contains the copolymerization product of the composition containing the hole-transportable compound having a chain-polymerizable functional group and the compound represented by the formula (1), a highly dense surface layer is obtained. Accordingly, even the surface layer containing a metal oxide can suppress moisture permeation, and hence can suppress the penetration of the photosensitive layer by moisture. The inventors presume that, as a result of the foregoing, the permeation of moisture into the photosensitive layer can be suppressed, leading to a satisfactory potential fluctuation suppressing effect at the time of long-term repeated use, under any environment.

Herein, from the viewpoint of the suppression of a potential fluctuation at the time of long-term repeated use, it is desired that the mass ratio $M_\alpha/M_\beta$ of the content $M_\alpha$ of the compound represented by the formula (1) in the surface layer to the content $M_\beta$ of the metal oxide particles in the surface layer satisfy the expression (A).

$$1 \leq M_\alpha/M_\beta \leq 45 \quad \text{Expression (A)}$$

In addition, it is more desired that the mass ratio $M_\alpha/(M_\beta+M_\gamma)$ of the content $M_\alpha$ of the compound represented by the formula (1) in the surface layer to the total of the content $M_\gamma$ of the hole-transportable compound having a chain-polymerizable functional group in the surface layer and the content $M_\beta$ of the metal oxide particles in the surface layer satisfy the expression (B).

$$0.1 \leq M_\alpha/(M_\beta+M_\gamma) \leq 1.0 \quad \text{Expression (B)}$$

Now, a mode for carrying out at least one embodiment of the present disclosure is described in detail.

Electrophotographic Photosensitive Member

The configuration of the electrophotographic photosensitive member according to at least one embodiment of the present disclosure is a configuration in which a charge-generating layer, a charge-transporting layer, and a protective layer are laminated in the stated order on a support. As required, an intermediate layer may be arranged between the charge-generating layer and the support, and an undercoat layer may be arranged between the intermediate layer and the support.

FIG. 1 is an illustration of an example of the layer configuration of the electrophotographic photosensitive member according to at least one embodiment of the present disclosure. In FIG. 1, an undercoat layer 22, a charge-generating layer 23, a charge-transporting layer 24, and a surface layer 25 are laminated on a support 21. In this case, the charge-generating layer 23 and the charge-transporting layer 24 constitute the photosensitive layer, and the surface layer 25 serves as the protective layer.

As described above, the surface layer contains: the copolymerization product of the composition containing the hole-transportable compound having a chain-polymerizable functional group and the compound represented by the formula (1); and the metal oxide particles. Now, the electrophotographic photosensitive member of the present disclosure is further described by taking, as an example, an electrophotographic photosensitive member which includes the protective layer and in which the protective layer is the surface layer 25.

The electrophotographic photosensitive member according to at least one embodiment of the present disclosure contains the hole-transportable compound having a chain-polymerizable functional group in the surface layer 25. In addition, the photosensitive layer may be formed as a single-layer photosensitive layer containing a charge-generating substance and a charge-transporting substance.

A method of producing the electrophotographic photosensitive member according to at least one embodiment of the present disclosure is, for example, a method involving: preparing coating liquids for the respective layers to be described later; sequentially applying the liquids for desired layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Now, the configuration of the electrophotographic photosensitive member according to at least one embodiment of the present disclosure is described.

Support

In the electrophotographic photosensitive member according to at least one embodiment of the present disclosure, the support 21 is preferably an electro-conductive support having electro-conductivity. In addition, examples of the shape of the support 21 include a cylindrical shape, a belt shape, and a sheet shape. Of those, a cylindrical support is preferred. In addition, the surface of the support 21 may be subjected to, for example, an electrochemical treatment, such as anodization, a blast treatment, or a cutting treatment.

A metal, a resin, glass, or the like is preferred as a material for the support 21. Examples of the metal include aluminum, iron, nickel, copper, gold, stainless steel, and alloys thereof. Of those, an aluminum support using aluminum is preferred.

In addition, conductivity is preferably imparted to the resin or the glass through a treatment involving, for example, mixing or coating the resin or the glass with a conductive material.

Intermediate Layer

In the electrophotographic photosensitive member according to at least one embodiment of the present disclosure, the intermediate layer may be arranged on the support 21. The arrangement of the intermediate layer can conceal flaws and irregularities in the surface of the support, and control the reflection of light on the surface of the support.

The intermediate layer preferably contains conductive particles and a resin.

A material for the conductive particles is, for example, a metal oxide, a metal, or carbon black. Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the conductive particles, and in particular, titanium oxide, tin oxide, and zinc oxide are more preferably used.

When the metal oxide is used as the conductive particles, the surface of the metal oxide may be treated with a silane coupling agent or the like, or the metal oxide may be doped with an element, such as phosphorus or aluminum, or an oxide thereof.

In addition, each of the conductive particles may be of a laminated construction having a core particle and a coating layer coating the particle. Examples of the core particle include titanium oxide, barium sulfate, and zinc oxide. The coating layer is, for example, a metal oxide, such as tin oxide.

In addition, when the metal oxide is used as the conductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the intermediate layer may further contain a concealing agent, such as a silicone oil, resin particles, or titanium oxide.

The intermediate layer may be formed by preparing a coating liquid for an intermediate layer containing the above-mentioned materials and a solvent, forming a coat thereof on the support, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for an intermediate layer, there are given methods using a paint shaker, a sand mill, a ball mill, and a liquid collision-type high-speed disperser.

The intermediate layer has an average thickness of preferably 0.1 μm or more and 50 μm or less, particularly preferably 3 μm or more and 40 μm or less.

Undercoat Layer

In the electrophotographic photosensitive member according to at least one embodiment of the present disclosure, the undercoat layer 22 may be arranged on the support 21 or the intermediate layer. The arrangement of the undercoat layer 22 can improve an adhesive function between layers to impart a charge injection-inhibiting function.

The undercoat layer 22 preferably contains a resin. In addition, the undercoat layer 22 may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer 22 may further contain an electron-transporting substance, a metal oxide, a metal, a conductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form the undercoat layer 22 as a cured film.

Examples of the metal oxide particles include indium tin oxide, tin oxide, indium oxide, titanium oxide, zinc oxide, aluminum oxide, and silicon dioxide. Examples of the metal include gold, silver, and aluminum.

The metal oxide particles to be contained in the undercoat layer 22 may be subjected to a surface treatment with a surface treatment agent, such as a silane coupling agent, before use.

A general method is used as a method of subjecting the metal oxide particles to the surface treatment. Examples thereof include a dry method and a wet method.

The dry method involves, while stirring the metal oxide particles in a mixer capable of high-speed stirring, such as a Henschel mixer, adding an alcoholic aqueous solution, organic solvent solution, or aqueous solution containing the surface treatment agent, uniformly dispersing the mixture, and then drying the dispersion.

In addition, the wet method involves stirring the metal oxide particles and the surface treatment agent in a solvent, or dispersing the metal oxide particles and the surface treatment agent in a solvent with a sand mill or the like using glass beads or the like. After the dispersion, the solvent is removed by filtration or evaporation under reduced pressure. After the removal of the solvent, it is preferred to further perform baking at 100° C. or more.

The undercoat layer 22 may further contain an additive, and for example, may contain a known material such as: powder of a metal, such as aluminum; a conductive substance, such as carbon black; a charge-transporting substance; a metal chelate compound; or an organometallic compound.

Examples of the charge-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. A charge-transporting substance having a polymerizable functional group may be used as the charge-transporting substance and copolymerized with the above-mentioned monomer having a polymerizable functional group to form the undercoat layer as a cured film.

The undercoat layer 22 may be formed by preparing a coating liquid for an undercoat layer containing the above-mentioned materials and a solvent, forming a coat thereof on the support or the intermediate layer, and drying and/or curing the coat.

Examples of the solvent to be used for the coating liquid for an undercoat layer include organic solvents, such as an alcohol, a sulfoxide, a ketone, an ether, an ester, an aliphatic halogenated hydrocarbon, and an aromatic compound. In at least one embodiment of the present disclosure, alcohol-based and ketone-based solvents are preferably used.

As a dispersion method for preparing the coating liquid for an undercoat layer, there are given methods using a homogenizer, an ultrasonic disperser, a ball mill, a sand mill, a roll mill, a vibration mill, an attritor, and a liquid collision-type high-speed disperser.

The undercoat layer 22 has an average thickness of preferably 0.1 μm or more and 50 μm or less, more preferably 0.2 μm or more and 40 μm or less, still more preferably 0.3 μm or more and 30 μm or less.

Photosensitive Layer

The photosensitive layer of the electrophotographic photosensitive member according to at least one embodiment of the present disclosure may be any of (1) a laminated photosensitive layer and (2) a single-layer photosensitive layer. (1) The laminated photosensitive layer is a photosensitive layer having a charge-generating layer 23 containing a charge-generating substance and a charge-transporting layer 24 containing a charge-transporting substance. (2) The single-layer photosensitive layer is a photosensitive layer containing both a charge-generating substance and a charge-transporting substance.

(1) Laminated Photosensitive Layer

The laminated photosensitive layer has the charge-generating layer 23 and the charge-transporting layer 24.

(1-1) Charge-Generating Layer

The charge-generating layer 23 preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are more preferred. Further, a hydroxygallium phthalocyanine pigment is particularly preferred from the viewpoint of high sensitivity. The content of the charge-generating substance in the charge-generating layer 23 is preferably 40 mass % or more and 85 mass % or less, more preferably 60 mass % or more and 80 mass % or less with respect to the total mass of the charge-generating layer 23.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer 23 may further contain an additive, such as an antioxidant or a UV absorber. Specific examples thereof include a hindered phenol compound, a hindered amine compound, a sulfur compound, a phosphorus compound, and a benzophenone compound.

The charge-generating layer 23 may be formed by preparing a coating liquid for a charge-generating layer containing the above-mentioned materials and a solvent, forming a coat thereof on the undercoat layer, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

The charge-generating layer 23 has an average thickness of preferably 0.01 μm or more and 10 μm or less, more preferably 0.1 μm or more and 1 μm or less.

(1-2) Charge-Transporting Layer

The charge-transporting layer 24 preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer 24 is preferably 25 mass % or more and 70 mass % or less, more preferably 30 mass % or more and 55 mass % or less with respect to the total mass of the charge-transporting layer 24.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer 24 may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles. Of those, the charge-transporting layer 24 particularly preferably contains a compound represented by the formula (2).

(2)

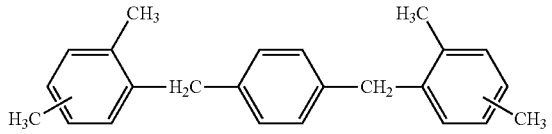

Examples of the compound represented by the formula (2) include compounds represented by the formulae (2-1) to (2-3).

(2-1)

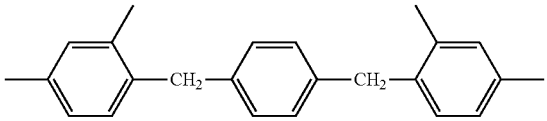

(2-2)

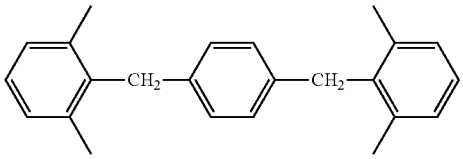

(2-3)

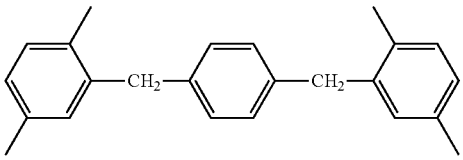

The charge-transporting layer 24 may be formed by preparing a coating liquid for a charge-transporting layer containing the above-mentioned materials and a solvent, forming a coat thereof on the charge-generating layer 23, and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

The charge-transporting layer 24 has an average thickness of 5 μm or more and 50 μm or less, more preferably 8 μm or more and 40 μm or less, particularly preferably 10 μm or more and 30 μm or less.

(2) Single-Layer Photosensitive Layer

The single-layer photosensitive layer may be formed by preparing a coating liquid for a photosensitive layer containing the charge-generating substance, the charge-transporting substance, a resin, and a solvent, forming a coat thereof on the undercoat layer, and drying the coat. Examples of the charge-generating substance, the charge-transporting substance, and the resin are the same as those of the materials in the section "(1) Laminated Photosensitive Layer."

Surface Layer

In at least one embodiment of the present disclosure, the protective layer serving as the surface layer 25 is arranged on the photosensitive layer. The arrangement of the protective layer can improve durability.

The surface layer 25 contains: the copolymerization product of the composition containing the hole-transportable compound having a chain-polymerizable functional group and the compound represented by the formula (1); and the metal oxide particles.

(1)

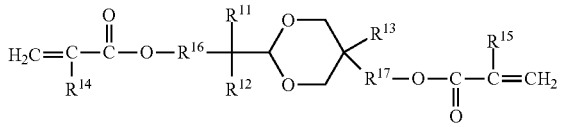

In the formula (1), $R^{11}$ and $R^{12}$ each independently represent an alkyl group having 1 or more and 4 or less carbon atoms. $R^{11}$ and $R^{12}$ may be bonded to each other to form a ring. $R^{13}$ represents an alkyl group having 1 or more and 4 or less carbon atoms. $R^{14}$ and $R^{15}$ each independently represent a hydrogen atom or a methyl group. $R^{16}$ and $R^{17}$ each independently represent an alkylene group having 1 or more and 4 or less carbon atoms.

In the compound represented by the formula (1), the alkyl group having 1 or more and 4 or less carbon atoms is one of a methyl group, an ethyl group, a n-propyl group, an isopropyl group, a n-butyl group, a sec-butyl group, a tert-butyl group, and an isobutyl group.

In the compound represented by the formula (1), the alkylene group having 1 or more and 4 or less carbon atoms is a divalent group obtained by removing one hydrogen atom from an alkyl group having 1 or more and 4 or less carbon atoms.

In the compound represented by the formula (1), examples of the ring formed by $R^{11}$ and $R^{12}$ bonded to each other include: a cyclopropyl group, a cyclobutyl group, and a cyclopentyl group each of which may be substituted with any one of a methyl group, an ethyl group, a propyl group, and an isopropyl group; a cyclohexyl group that may be substituted with any one of a methyl group and an ethyl group; a cycloheptyl group that may be substituted with a methyl group; and an unsubstituted cyclooctyl group.

Examples of the compound represented by the formula (1) include compounds represented by the formulae (1-1) to (1-20).

(1-1)

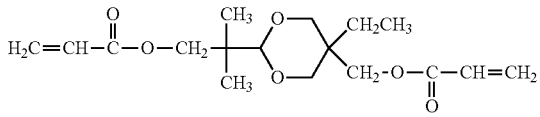

(1-2)

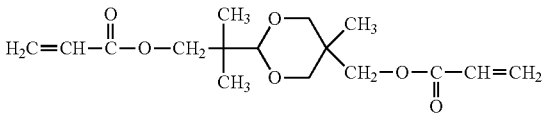

(1-3)

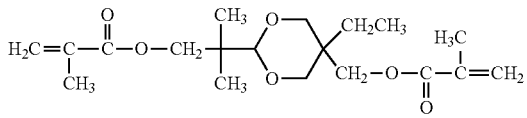

(1-4)

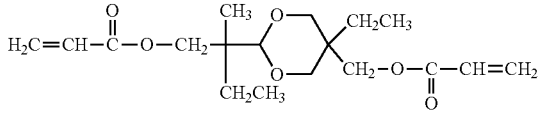

-continued (1-5)

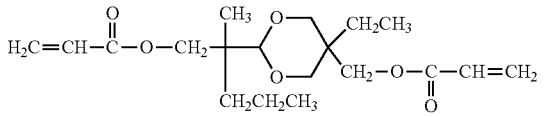

(1-6)

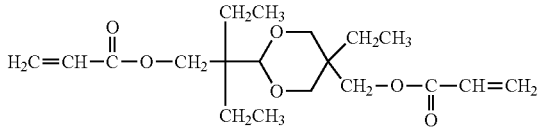

(1-7)

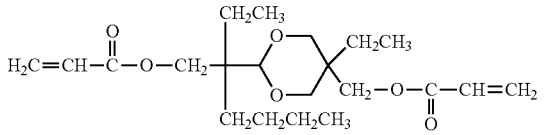

(1-8)

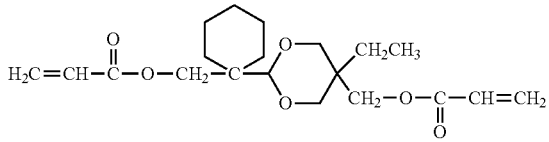

(1-9)

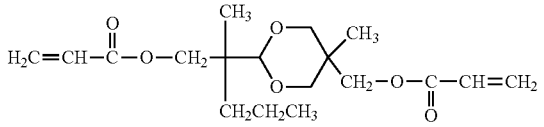

(1-10)

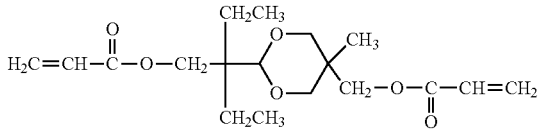

(1-11)

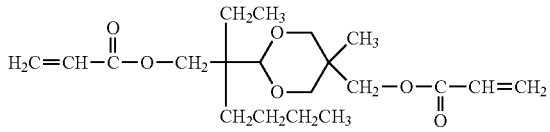

(1-12)

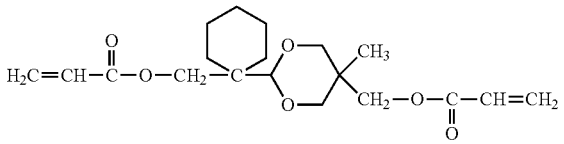

(1-13)

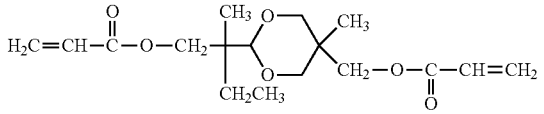

(1-14)

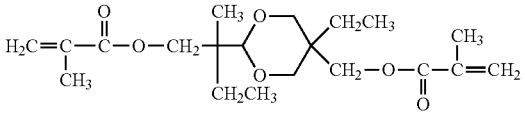

-continued (1-15)

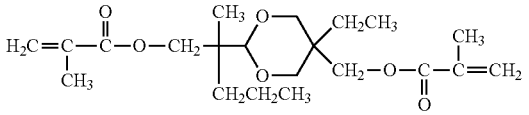

(1-16)

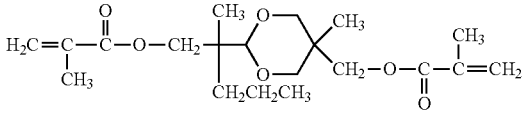

(1-17)

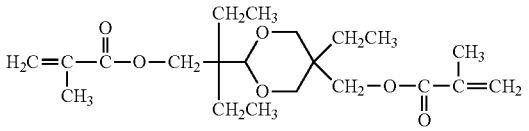

(1-18)

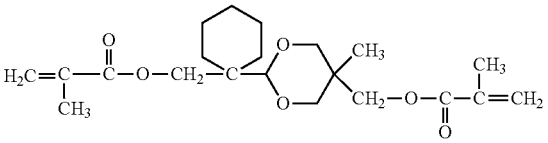

(1-19)

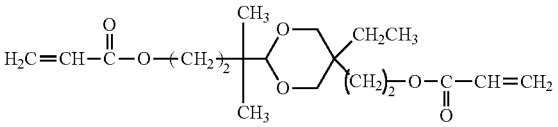

(1-20)

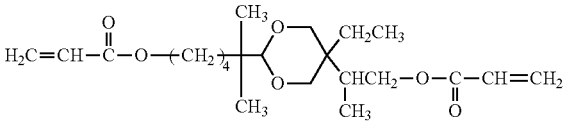

Examples of the hole-transporting compound having a chain-polymerizable functional group include a polycyclic aromatic compound, a heterocyclic compound, a hydrazone compound, a styryl compound, an enamine compound, a benzidine compound, a triaryl amine compound, and a resin having a group derived from each of those substances. The hole-transportable compound having a chain-polymerizable functional group preferably has one chain-polymerizable functional group. Examples thereof include compounds represented by the formulae (6-1) to (6-12).

(6-1)

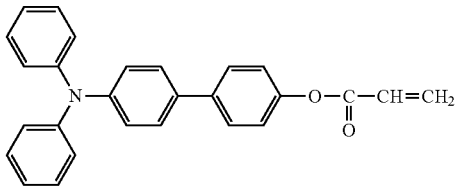

-continued
(6-2)
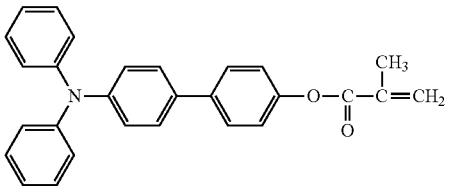
(6-3)
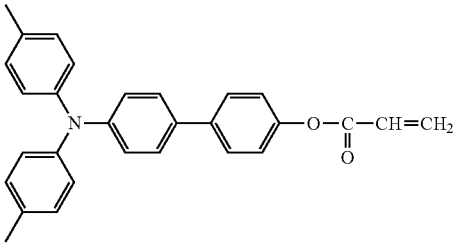
(6-4)
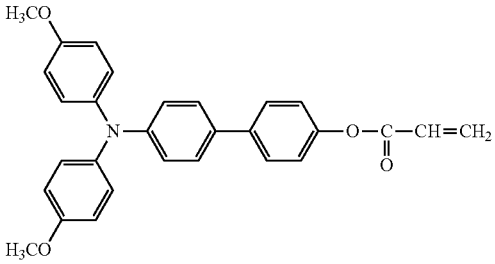
(6-5)
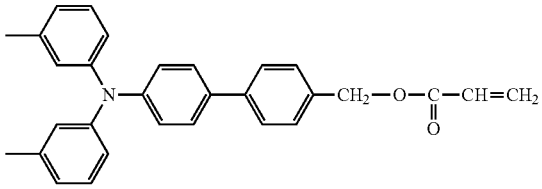
(6-6)
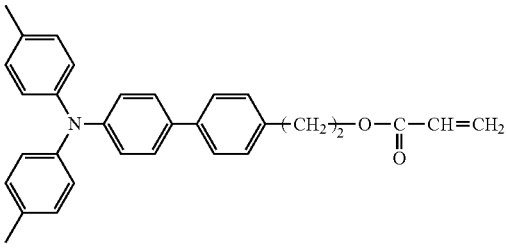
(6-7)
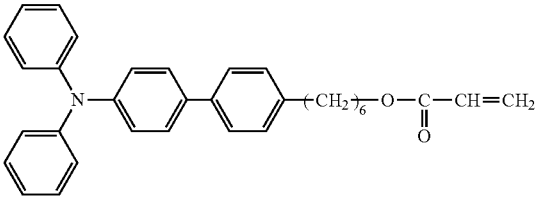
-continued
(6-8)
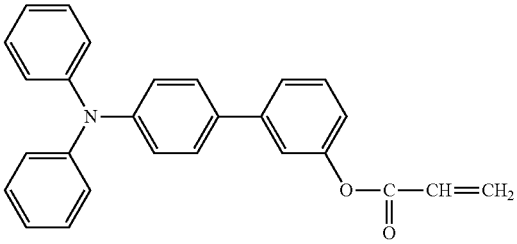
(6-9)
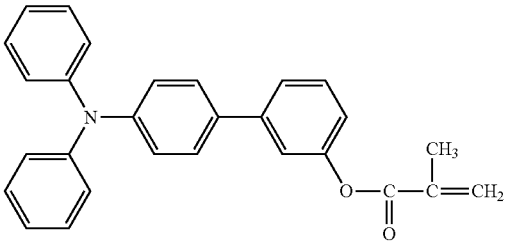
(6-10)
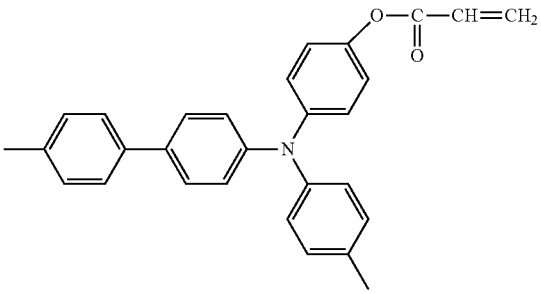
(6-11)
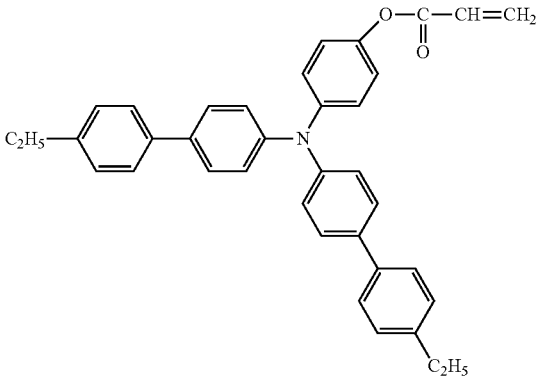

-continued (6-12)

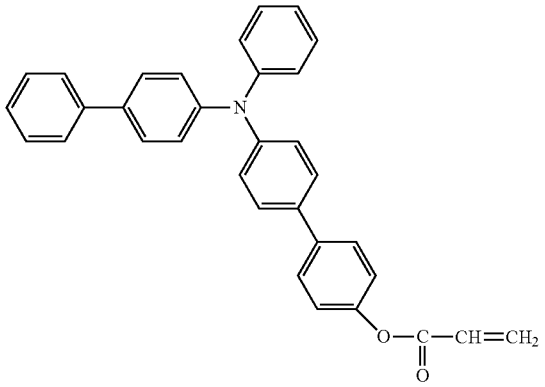

The surface layer 25 may be formed as a cured film by polymerizing a composition containing a monomer having a polymerizable functional group. As a reaction in this case, there are given, for example, a thermal polymerization reaction, a photopolymerization reaction, and a radiation polymerization reaction. Examples of the polymerizable functional group of the monomer having a polymerizable functional group include an acryloyloxy group and a methacryloyloxy group. A material having a charge-transporting ability may be used as the monomer having a polymerizable functional group.

Examples of the metal oxide particles to be contained in the surface layer 25 include alumina, titanium oxide, zinc oxide, tin oxide, and indium oxide. Those metal oxide particles may be used alone or in combination thereof. The metal oxide particles to be contained in the surface layer 25 may be subjected to a surface treatment with a surface treatment agent, such as a silane coupling agent, before use. A general method is used as a method of subjecting the metal oxide particles to the surface treatment. Examples thereof include a dry method and a wet method.

The number-average primary particle diameter of the metal oxide particles to be contained in the surface layer 25 is preferably 5 nm or more and 0.5 μm or less, more preferably 20 nm or more and 0.4 μm or less.

The surface layer may contain a resin. Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

In addition, the surface layer may contain an additive, such as an antioxidant, a UV absorber, a plasticizer, a leveling agent, a lubricity-imparting agent, and a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, and boron nitride particles.

The surface layer preferably further contains a compound represented by the formula (3) from the viewpoint of improving the film denseness of the surface layer.

(3)

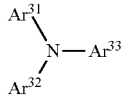

In the formula (3), $Ar^{31}$ to $Ar^{33}$ each independently represent a substituted or unsubstituted phenyl group or a substituted or unsubstituted biphenyl group. At least one of $Ar^{31}$ to $Ar^{33}$ represents a substituted or unsubstituted biphenyl group. At least one of $Ar^{31}$ to $Ar^{33}$ has a substituent represented by the formula (4). A substituent of each of the substituted phenyl group and the substituted biphenyl group is an alkyl group, an alkoxy group, a group represented by the formula (4), or a group represented by the formula (5).

(4)

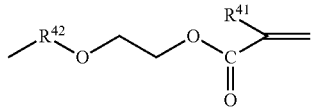

In the formula (4), $R^{41}$ represents a hydrogen atom or a methyl group, and $R^{42}$ represents an alkylene group having 1 or more and 6 or less carbon atoms.

(5)

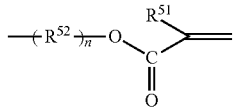

In the formula (5), $R^{51}$ represents a hydrogen atom or a methyl group, $R^{52}$ represents an alkylene group having 1 or more and 6 or less carbon atoms, and "n" represents 0 or 1.

In each of the group represented by the formula (4) and the group represented by the formula (5), examples of the alkylene group having 1 or more and 6 or less carbon atoms include a methylene group, an ethylene group, a propylene group, a butylene group, a pentylene group, and a hexylene group.

Examples of the compound represented by the formula (3) include compounds represented by the formulae (3-1) to (3-12).

(3-1)

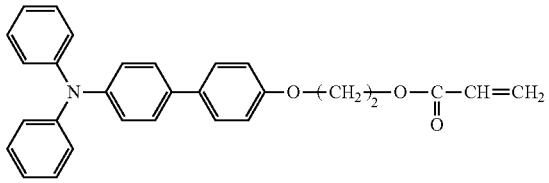

(3-2)

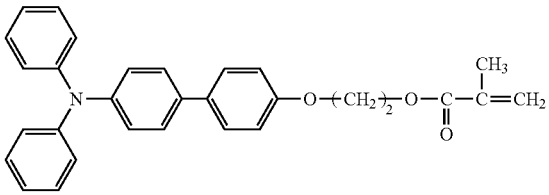

-continued (3-3)

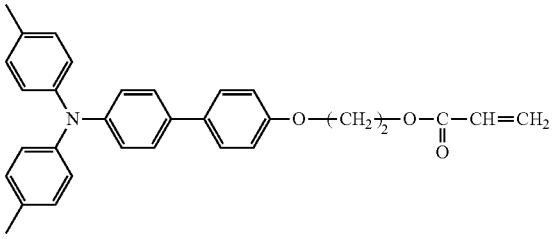

(3-4)

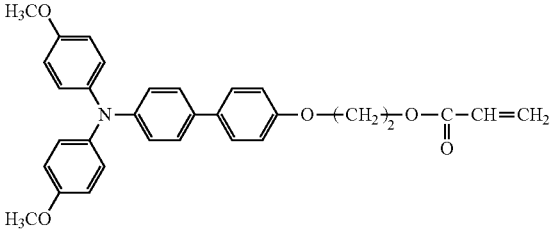

(3-5)

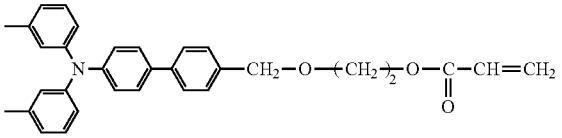

(3-6)

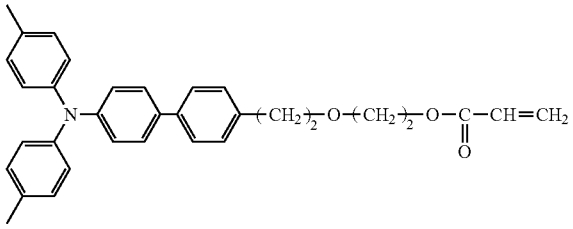

(3-7)

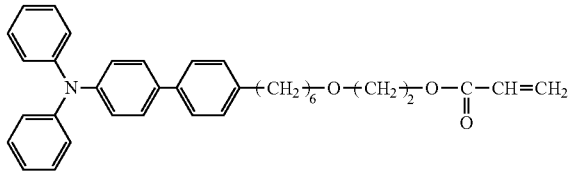

(3-8)

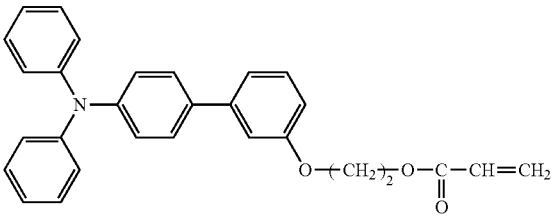

(3-9)

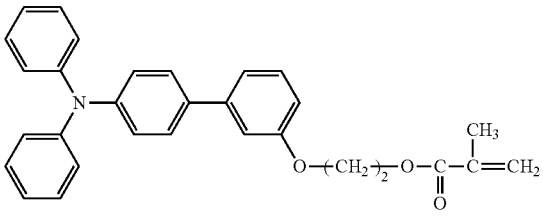

-continued (3-10)

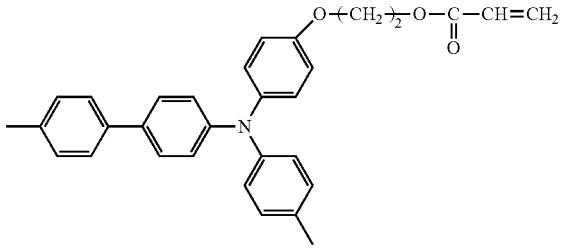

(3-11)

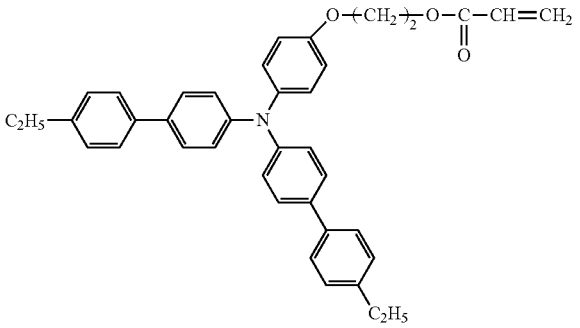

(3-12)

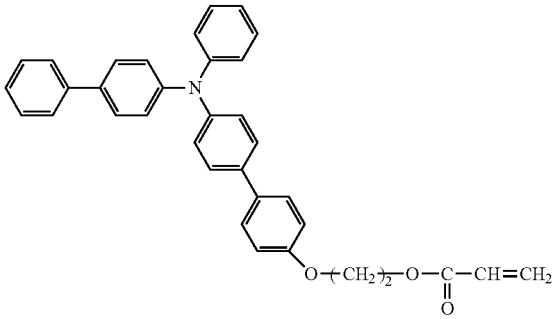

The surface layer may be formed by preparing a coating liquid for a surface layer containing the above-mentioned materials and a solvent, forming a coat thereof on the photosensitive layer (charge-transporting layer 24), and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

The surface layer has an average thickness of preferably 0.5 μm or more and 10 μm or less, more preferably 1 μm or more and 7 μm or less.

Surface Processing of Electrophotographic Photosensitive Member

In at least one embodiment of the present disclosure, the electrophotographic photosensitive member may be subjected to surface processing to form depressions or projections on its surface. When the surface processing is performed, the behavior of a cleaning unit (cleaning blade) to be brought into contact with the electrophotographic photosensitive member can be further stabilized. As a method for the surface processing, there are given: a method involving bringing a mold having projections into pressure contact with the surface of the electrophotographic photosensitive member to perform shape transfer; and a method involving imparting depressed and projected shapes by mechanical polishing.

The depressions or the projections may be formed over the entirety of the surface of the electrophotographic photosensitive member, or may be formed on part of the surface of the electrophotographic photosensitive member. When the depressions or the projections are formed on part of the surface of the electrophotographic photosensitive member, it is preferred that the depressions or the projections be formed at least over the entirety of a region with which the cleaning unit (cleaning blade) is to be brought into contact.

When the depressions are formed, the depressions may be formed on the surface of the electrophotographic photosensitive member by bringing a mold having projections corresponding to the depressions into pressure contact with the surface of the electrophotographic photosensitive member to perform shape transfer.

Process Cartridge and Electrophotographic Apparatus

A process cartridge according to at least one embodiment of the present disclosure integrally supports the electrophotographic photosensitive member according to at least one embodiment of the present disclosure described in the foregoing, and at least one unit selected from the group consisting of a charging unit, a developing unit, and a cleaning unit, and is removably mounted onto the main body of an electrophotographic apparatus.

In addition, an electrophotographic apparatus according to at least one embodiment of the present disclosure includes the electrophotographic photosensitive member described in the foregoing, and at least one unit selected from the group consisting of a charging unit, an exposing unit, a developing unit, and a transferring unit.

Figure 2:
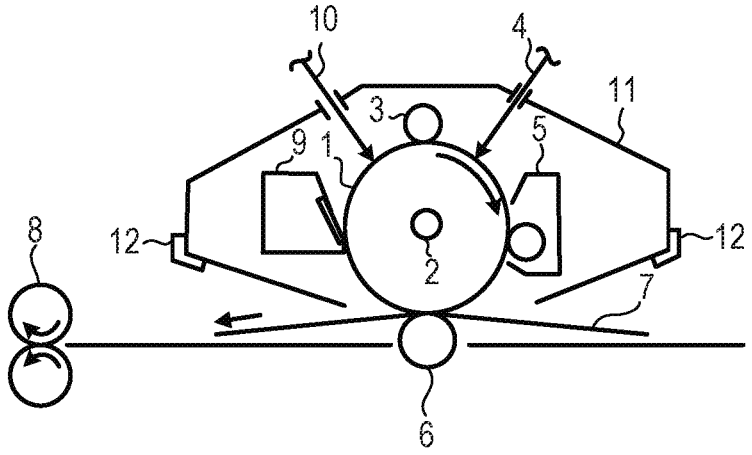
FIG. 2 is a view for illustrating an example of the schematic configuration of a process cartridge including the electrophotographic photosensitive member according to at least one embodiment of the present disclosure and an electrophotographic apparatus including the process cartridge.

An example of the schematic construction of an electrophotographic apparatus including a process cartridge 11 including an electrophotographic photosensitive member 1 is illustrated in FIG. 2.

The electrophotographic photosensitive member 1 of a cylindrical shape (drum shape) is rotationally driven about a shaft 2 in a direction indicated by the arrow at a predetermined peripheral speed (process speed). The surface of the electrophotographic photosensitive member 1 is charged to a predetermined positive or negative potential by a charging unit 3 in the rotational process. In FIG. 2, a roller charging system based on a roller-type charging member is illustrated, but a charging system such as a corona charging system, a proximity charging system, or an injection charging system may be adopted. The charged surface of the electrophotographic photosensitive member 1 is irradiated with exposure light 4 from an exposing unit (not shown), and hence an electrostatic latent image corresponding to target image information is formed thereon. The exposure light 4 is light whose intensity has been modulated in correspondence with a time-series electric digital image signal of information on a target image, and is output, for example, from an image exposing unit, such as slit exposure or laser beam scanning exposure. The electrostatic latent image formed on the surface of the electrophotographic photosensitive member 1 is developed (normal development or reversal development) with toner stored in a developing unit 5 to form a toner image on the surface of the electrophotographic photosensitive member 1. The toner image formed on the surface of the electrophotographic photosensitive member 1 is transferred by a transferring unit 6 onto a transfer material 7. At this time, a bias voltage opposite in polarity to charge that the toner possesses is applied from a bias power source (not shown) to the transferring unit 6. In addition, when the transfer material 7 is paper, the transfer material 7 is taken out of a sheet feeding portion (not shown) and supplied to a space between the electrophotographic photosensitive member 1 and the transferring unit 6 in synchronization with the rotation of the electrophotographic photosensitive member 1. The transfer material 7 onto which the toner image has been transferred from the electrophotographic photosensitive member 1 is separated from the surface of the electrophotographic photosensitive member 1, is conveyed to a fixing unit 8, and is subjected to a treatment for fixing the toner image to be printed out as an image-formed product (a print or a copy) to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system configured to remove the deposit with the developing unit or the like without separate arrangement of the cleaning unit may be used. In at least one embodiment of the present disclosure, a plurality of components selected from the electrophotographic photosensitive member 1, the charging unit 3, the developing unit 5, the cleaning unit 9, and the like may be stored in a container and integrally supported to form the process cartridge 11, which may be removably mounted onto the main body of the electrophotographic apparatus. For example, such a configuration as described below is adopted. At least one selected from the charging unit 3, the developing unit 5, and the cleaning unit 9 is integrally supported with the electrophotographic photosensitive member 1 to form a cartridge. The cartridge may be used as the process cartridge 11 to be removably mounted onto the main body of the electrophotographic apparatus with a guiding unit 12, such as a rail of the main body of the electrophotographic apparatus. The electrophotographic apparatus may include an electricity-removing mechanism configured to subject the surface of the electrophotographic photosensitive member 1 to an electricity-removing treatment with pre-exposure light 10 from a pre-exposing unit (not shown). In addition, the guiding unit 12, such as the rail, may be arranged for removably mounting the process cartridge 11 according to at least one embodiment of the present disclosure onto the main body of the electrophotographic apparatus. The electrophotographic apparatus according to at least one embodiment of the present disclosure includes the electrophotographic photosensitive member 1 and at least one unit selected from the group consisting of the charging unit 3, the exposing unit, the developing unit 5, and the transferring unit 6.

The electrophotographic photosensitive member according to at least one embodiment of the present disclosure can be used in, for example, a laser beam printer, an LED printer, a copying machine, a facsimile, and a multifunctional peripheral thereof.

EXAMPLES

The present disclosure is described in more detail below by way of Examples and Comparative Examples. The present disclosure is by no means limited to the following Examples, and various modifications may be made without departing from the gist of the present disclosure. In the description in the following Examples, "part(s)" is by mass unless otherwise specified.

Example 1

Support

A cylindrical aluminum cylinder (JIS-A3003, aluminum alloy, diameter: 30 mm, length: 357.5 mm, thickness: 1.0 mm) was used as a support (electro-conductive support).

Formation of Intermediate Layer

5 Parts of N-methoxymethylated nylon (product name: FR101, manufactured by Namariichi Co., Ltd.) was dissolved in a mixed solvent of 70 parts of methanol and 30 parts of 1-butanol to prepare a coating liquid for an intermediate layer.

The resultant coating liquid for an intermediate layer was applied onto the support by dip coating to form a coat, and the coat was dried at 130° C. for 10 minutes to form an intermediate layer having a thickness of 0.7 μm.

Formation of Undercoat Layer

24 Parts of an alkyd resin (product name: BECKOSOL 1307-60-EL, manufactured by DIC Corporation) and 16 parts of a melamine resin (product name: SUPER BECKAMINE G-821-60, manufactured by DIC Corporation) were dissolved in 500 parts of methyl ethyl ketone. To the solution, 160 parts of titanium oxide (CR-EL, manufactured by Ishihara Sangyo Kaisha, Ltd.) was added, and the mixture was dispersed under an atmosphere at 23±3° C. for 10 hours with a sand mill apparatus using glass beads each having a diameter of 0.8 mm to prepare a coating liquid for an undercoat layer.

The resultant coating liquid for an undercoat layer was applied onto the intermediate layer by dip coating to form a coat, and the coat was dried at 110° C. for 20 minutes to form an undercoat layer having a thickness of 3.5 μm.

Formation of Charge-Generating Layer

Next, 8 parts of a titanyl phthalocyanine pigment (a titanyl phthalocyanine pigment having the maximum diffraction peak at least at a position of 27.3° in Cu-Kα characteristic X-ray diffraction spectrometry), 5 parts of polyvinyl butyral (product name: S-LEC BX-1, manufactured by Sekisui Chemical Co., Ltd.), and 400 parts of 2-butanone were mixed. After that, the mixture was subjected to a dispersion treatment under an atmosphere at 23±3° C. for 1 hour with a sand mill using glass beads each having a diameter of 1 mm to prepare a coating liquid for a charge-generating layer. The coating liquid for a charge-generating layer was applied onto the undercoat layer by dip coating, and the resultant coat was dried at 90° C. for 10 minutes to form a charge-generating layer having a thickness of 0.3 μm.

Formation of Charge-Transporting Layer

10 Parts of bisphenol Z-type polycarbonate (Panlite TS-2050, manufactured by Teijin Chemicals Ltd.), 10 parts of 4,4'-dimethyl-4"-(β-phenylstyryl)triphenylamine, 0.1 part of the compound represented by the formula (2-1), 80 parts of tetrahydrofuran, and 0.1 part of a silicone oil KF50-100CS (manufactured by Shin-Etsu Chemical Co., Ltd.) were mixed to prepare a coating liquid for a charge-transporting layer.

The coating liquid for a charge-transporting layer was applied onto the charge-generating layer by dip coating to form a coat, and the coat was dried by heating at 110° C. for 60 minutes to form a charge-transporting layer having a thickness of 22 μm.

Formation of Surface Layer

10 Parts of α-alumina (product name: Sumicorundum AA-03, manufactured by Sumitomo Chemical Industry Company Limited), 0.1 part of a dispersant (product name: AL-10, manufactured by Takemoto Oil & Fat Co., Ltd.), and 300.8 parts of tetrahydrofuran were mixed. After that, the mixture was subjected to a dispersion treatment under an atmosphere at 23±3° C. for 6 hours with a sand mill using glass beads each having a diameter of 0.5 mm to provide an α-alumina dispersion liquid (1).

After that, 43 parts of the hole-transportable compound represented by the formula (6-3), 42 parts of the compound represented by the formula (1-1), 0.1 part of a mixture of acrylic group-containing polyester-modified polydimethylsiloxane and propoxy-modified 2-neopentyl glycol diacrylate (BYK-UV3570, manufactured by BYK-Chemie GmbH), 0.1 part of the compound represented by the formula (3-3), 4 parts of 1-hydroxycyclohexyl phenyl ketone (Irgacure 184, manufactured by Ciba Specialty Chemicals Inc.), and 100 parts of tetrahydrofuran were added to the α-alumina dispersion liquid (1) prepared above, and the resultant mixture was filtered through a polyflon filter (product name: PF-040, manufactured by Advantec Toyo Kaisha, Ltd.) to prepare a coating liquid for a surface layer.

The coating liquid for a surface layer was applied onto the charge-transporting layer by dip coating to form a coat, and the coat was irradiated with UV light for 2 minutes under a nitrogen atmosphere through the use of a metal halide lamp under the conditions of a distance between the light source and the photosensitive member surface of 50 mm and a lamp output of 4 kW. The resultant coat was dried at 40° C. for 5 minutes to form a surface layer having a thickness of 3.5 μm.

Thus, an electrophotographic photosensitive member was produced.

Example 2

An electrophotographic photosensitive member was produced in the same manner as in Example 1 except that the compound represented by the formula (6-3) was changed to the compound represented by the formula (6-1) in the preparation of the coating liquid for a surface layer.

Example 3

An electrophotographic photosensitive member was produced in the same manner as in Example 1 except that the compound represented by the formula (6-3) was changed to the compound represented by the formula (7) in the preparation of the coating liquid for a surface layer.

(7)

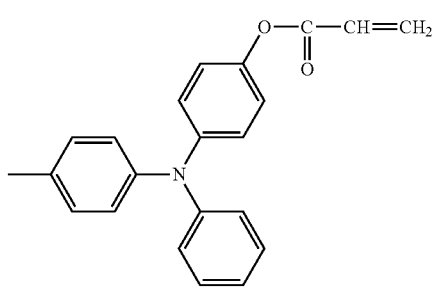

Example 4

100 Parts by mass of tin oxide particles (number-average primary particle diameter: 15 nm), 30 parts by mass of a silane coupling agent (product name: KBM-503, manufactured by Shin-Etsu Silicone), and 900 parts by mass of methyl ethyl ketone were loaded into a wet sand mill, and glass beads each having a diameter of 0.5 mm were further added, followed by a dispersion treatment for 6 hours. After that, the methyl ethyl ketone and the glass beads were separated by filtration, and the resultant was subjected to a drying treatment at 60° C. to provide tin oxide particles having surfaces treated with a silane coupling agent having a methacryloyloxy group.

10 Parts of the tin oxide particles having surfaces treated with the silane coupling agent, 0.1 part of a dispersant (product name: AL-10, manufactured by Takemoto Oil & Fat Co., Ltd.), and 300.8 parts of tetrahydrofuran were mixed. After that, the mixture was subjected to a dispersion treatment under an atmosphere at 23±3° C. for 6 hours with a sand mill using glass beads each having a diameter of 0.5 mm to provide a surface-treated tin oxide dispersion liquid.

An electrophotographic photosensitive member was produced in the same manner as in Example 1 except that in Example 1, the α-alumina dispersion liquid (1) was changed to the surface-treated tin oxide dispersion liquid in the preparation of the coating liquid for a surface layer.

Example 5

5 Parts of titanium oxide particles (product name: CR-EL, manufactured by Ishihara Sangyo Kaisha, Ltd., rutile content: 99.1%), 5 parts of titanium oxide particles (product name: PT-401M, manufactured by Ishihara Sangyo Kaisha, Ltd., rutile content: 46.7%), 0.1 part of a dispersant (product name: AL-10, manufactured by Takemoto Oil & Fat Co., Ltd.), and 300.8 parts of tetrahydrofuran were mixed. After that, the mixture was subjected to a dispersion treatment under an atmosphere at 23±3° C. for 10 hours with a sand mill using glass beads each having a diameter of 0.5 mm to provide a titanium oxide dispersion liquid.

An electrophotographic photosensitive member was produced in the same manner as in Example 1 except that in Example 1, the α-alumina dispersion liquid (1) was changed to the titanium oxide dispersion liquid in the preparation of the coating liquid for a surface layer.

Example 6

An electrophotographic photosensitive member was produced in the same manner as in Example 1 except that the compound represented by the formula (1-1) was changed to the compound represented by the formula (1-3) in the preparation of the coating liquid for a surface layer.

Example 7

An electrophotographic photosensitive member was produced in the same manner as in Example 1 except that in the preparation of the coating liquid for a surface layer, 42 parts of the compound represented by the formula (1-1) was changed to 21 parts of the compound represented by the formula (1-1) and 21 parts of trimethylolpropane triacrylate (product name: KAYARAD TMPTA, manufactured by Nippon Kayaku Co., Ltd.) was added.

Example 8

An electrophotographic photosensitive member was produced in the same manner as in Example 7 except that trimethylolpropane triacrylate (product name: KAYARAD TMPTA, manufactured by Nippon Kayaku Co., Ltd.) was changed to caprolactone-modified dipentaerythritol hexaacrylate (product name: KAYARAD DPCA-120, manufactured by Nippon Kayaku Co., Ltd.) in the preparation of the coating liquid for a surface layer.

Example 9

An electrophotographic photosensitive member was produced in the same manner as in Example 1 except that the coating liquid for a surface layer was prepared as described below.

12 Parts of α-alumina (product name: Sumicorundum AA-03, manufactured by Sumitomo Chemical Industry Company Limited), 0.15 part of a dispersant (product name: AL-10, manufactured by Takemoto Oil & Fat Co., Ltd.), and 300.8 parts of tetrahydrofuran were mixed. After that, the mixture was subjected to a dispersion treatment under an atmosphere at 23±3° C. for 6 hours with a sand mill using glass beads each having a diameter of 0.5 mm to provide an α-alumina dispersion liquid (2).

After that, 43 parts of the hole-transportable compound represented by the formula (6-3), 14 parts of the compound represented by the formula (1-1), 0.1 part of a mixture of acrylic group-containing polyester-modified polydimethylsiloxane and propoxy-modified 2-neopentyl glycol diacrylate (BYK-UV3570, manufactured by BYK-Chemie GmbH), 0.1 part of the compound represented by the formula (3-3), 2.8 parts of 1-hydroxycyclohexyl phenyl ketone (Irgacure 184, manufactured by Ciba Specialty Chemicals Inc.), and 100 parts of tetrahydrofuran were added to the α-alumina dispersion liquid (2), and the resultant mixture was filtered through a polyflon filter (product name: PF-040, manufactured by Advantec Toyo Kaisha, Ltd.) to prepare a coating liquid for a surface layer.

Example 10

An electrophotographic photosensitive member was produced in the same manner as in Example 1 except that the coating liquid for a surface layer was prepared as described below.

1.0 Part of α-alumina (product name: Sumicorundum AA-03, manufactured by Sumitomo Chemical Industry Company Limited), 0.01 part of a dispersant (product name: AL-10, manufactured by Takemoto Oil & Fat Co., Ltd.), and 300.8 parts of tetrahydrofuran were mixed. After that, the mixture was subjected to a dispersion treatment under an atmosphere at 23±3° C. for 6 hours with a sand mill using glass beads each having a diameter of 0.5 mm to provide an α-alumina dispersion liquid (3).

The coating liquid for a surface layer was prepared by changing the α-alumina dispersion liquid (1) in the coating liquid for a surface layer of Example 1 to the α-alumina dispersion liquid (3).

Example 11

An electrophotographic photosensitive member was produced in the same manner as in Example 1 except that the coating liquid for a surface layer was prepared as described below.

43 Parts of the hole-transportable compound represented by the formula (6-3), 10 parts of the compound represented by the formula (1-1), 0.1 part of a mixture of acrylic group-containing polyester-modified polydimethylsiloxane and propoxy-modified 2-neopentyl glycol diacrylate (BYK-UV3570, manufactured by BYK-Chemie GmbH), 0.1 part of the compound represented by the formula (3-3), 2.7 parts of 1-hydroxycyclohexyl phenyl ketone (Irgacure 184, manufactured by Ciba Specialty Chemicals Inc.), and 100 parts of tetrahydrofuran were added to the α-alumina dispersion liquid (2), and the resultant mixture was filtered through a polyflon filter (product name: PF-040, manufactured by Advantec Toyo Kaisha, Ltd.) to prepare the coating liquid for a surface layer.

Example 12

An electrophotographic photosensitive member was produced in the same manner as in Example 1 except that the coating liquid for a surface layer was prepared as described below.

0.8 Part of α-alumina (product name: Sumicorundum AA-03, manufactured by Sumitomo Chemical Industry Company Limited), 0.08 part of a dispersant (product name: AL-10, manufactured by Takemoto Oil & Fat Co., Ltd.), and 300.8 parts of tetrahydrofuran were mixed. After that, the mixture was subjected to a dispersion treatment under an atmosphere at 23±3° C. for 6 hours with a sand mill using glass beads each having a diameter of 0.5 mm to provide an α-alumina dispersion liquid (4).

The coating liquid for a surface layer was prepared by changing the α-alumina dispersion liquid (1) in the coating liquid for a surface layer of Example 1 to the α-alumina dispersion liquid (4).

Example 13

An electrophotographic photosensitive member was produced in the same manner as in Example 1 except that the coating liquid for a surface layer was prepared as described below.

20 Parts of α-alumina (product name: Sumicorundum AA-03, manufactured by Sumitomo Chemical Industry Company Limited), 0.2 part of a dispersant (product name: AL-10, manufactured by Takemoto Oil & Fat Co., Ltd.), and 300.8 parts of tetrahydrofuran were mixed. After that, the mixture was subjected to a dispersion treatment under an atmosphere at 23±3° C. for 6 hours with a sand mill using glass beads each having a diameter of 0.5 mm to provide an α-alumina dispersion liquid (5).

After that, 60 parts of the hole-transportable compound represented by the formula (6-3), 7.0 parts of the compound represented by the formula (1-1), 0.1 part of a mixture of acrylic group-containing polyester-modified polydimethylsiloxane and propoxy-modified 2-neopentyl glycol diacrylate (BYK-UV3570, manufactured by BYK-Chemie GmbH), 0.1 part of the compound represented by the formula (3-3), 3.2 parts of 1-hydroxycyclohexyl phenyl ketone (Irgacure 184, manufactured by Ciba Specialty Chemicals Inc.), and 100 parts of tetrahydrofuran were added to the α-alumina dispersion liquid (5), and the resultant mixture was filtered through a polyflon filter (product name: PF-040, manufactured by Advantec Toyo Kaisha, Ltd.) to prepare a coating liquid for a surface layer.

Example 14

An electrophotographic photosensitive member was produced in the same manner as in Example 1 except that the coating liquid for a surface layer was prepared as described below.

38 Parts of the hole-transportable compound represented by the formula (6-3), 42 parts of the compound represented by the formula (1-1), 0.1 part of a mixture of acrylic group-containing polyester-modified polydimethylsiloxane and propoxy-modified 2-neopentyl glycol diacrylate (BYK-UV3570, manufactured by BYK-Chemie GmbH), 0.1 part of the compound represented by the formula (3-3), 4 parts of 1-hydroxycyclohexyl phenyl ketone (Irgacure 184, manufactured by Ciba Specialty Chemicals Inc.), and 100 parts of tetrahydrofuran were added to the α-alumina dispersion liquid (4), and the resultant mixture was filtered through a polyflon filter (product name: PF-040, manufactured by Advantec Toyo Kaisha, Ltd.) to prepare the coating liquid for a surface layer.

Example 15

An electrophotographic photosensitive member was produced in the same manner as in Example 1 except that the hole-transportable compound represented by the formula (6-3) was changed to a hole-transportable compound represented by the formula (8) in the preparation of the coating liquid for a surface layer.

(8)

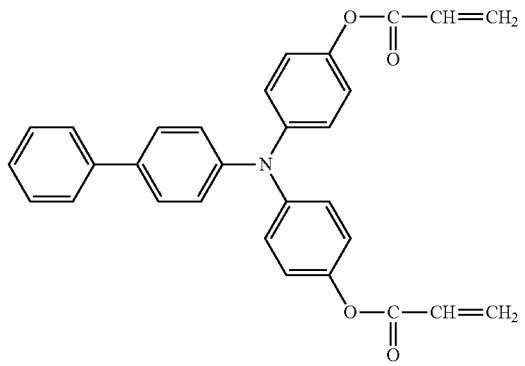

Example 16

An electrophotographic photosensitive member was produced in the same manner as in Example 1 except that the hole-transportable compound represented by the formula (6-3) was changed to a hole-transportable compound represented by the formula (9) in the preparation of the coating liquid for a surface layer.

(9)

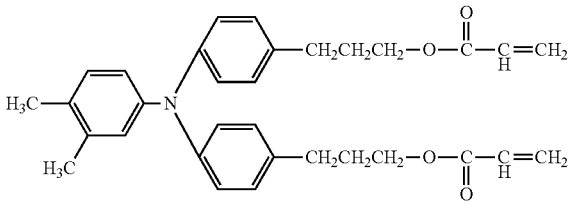

Example 17

An electrophotographic photosensitive member was produced in the same manner as in Example 1 except that the compound represented by the formula (2-1) was not used in the preparation of the coating liquid for a charge-transporting layer.

Example 18

An electrophotographic photosensitive member was produced in the same manner as in Example 1 except that the compound represented by the formula (3-3) was not used in the preparation of the coating liquid for a surface layer.

Example 19

An electrophotographic photosensitive member was produced in the same manner as in Example 1 except that the compound represented by the formula (1-1) was changed to the compound represented by the formula (1-5) in the preparation of the coating liquid for a surface layer.

Example 20

An electrophotographic photosensitive member was produced in the same manner as in Example 1 except that the compound represented by the formula (1-1) was changed to the compound represented by the formula (1-6) in the preparation of the coating liquid for a surface layer.

Example 21

An electrophotographic photosensitive member was produced in the same manner as in Example 20 except that the compound represented by the formula (3-3) was not used in the preparation of the coating liquid for a surface layer.

Example 22

An electrophotographic photosensitive member was produced in the same manner as in Example 21 except that the compound represented by the formula (2-1) was not used in the preparation of the coating liquid for a charge-transporting layer.

Example 23

An electrophotographic photosensitive member was produced in the same manner as in Example 22 except that the hole-transportable compound represented by the formula (6-3) was changed to the hole-transportable compound represented by the formula (8) in the preparation of the coating liquid for a surface layer.

Example 24

An electrophotographic photosensitive member was produced in the same manner as in Example 17 except that the coating liquid for a surface layer was prepared as described below.

60 Parts of the hole-transportable compound represented by the formula (8), 7 parts of the compound represented by the formula (1-6), 0.1 part of a mixture of acrylic group-containing polyester-modified polydimethylsiloxane and propoxy-modified 2-neopentyl glycol diacrylate (BYK-UV3570, manufactured by BYK-Chemie GmbH), 3.2 parts of 1-hydroxycyclohexyl phenyl ketone (Irgacure 184, manufactured by Ciba Specialty Chemicals Inc.), and 100 parts of tetrahydrofuran were added to the α-alumina dispersion liquid (5), and the resultant mixture was filtered through a polyflon filter (product name: PF-040, manufactured by Advantec Toyo Kaisha, Ltd.) to prepare the coating liquid for a surface layer.

Example 25

An electrophotographic photosensitive member was produced in the same manner as in Example 17 except that the coating liquid for a surface layer was prepared as described below.

38 Parts of the hole-transportable compound represented by the formula (8), 42 parts of the compound represented by the formula (1-6), 0.1 part of a mixture of acrylic group-containing polyester-modified polydimethylsiloxane and propoxy-modified 2-neopentyl glycol diacrylate (BYK-UV3570, manufactured by BYK-Chemie GmbH), 4 parts of 1-hydroxycyclohexyl phenyl ketone (Irgacure 184, manufactured by Ciba Specialty Chemicals Inc.), and 100 parts of tetrahydrofuran were added to the α-alumina dispersion liquid (4), and the resultant mixture was filtered through a polyflon filter (product name: PF-040, manufactured by Advantec Toyo Kaisha, Ltd.) to prepare the coating liquid for a surface layer.

Comparative Example 1

An electrophotographic photosensitive member was produced in the same manner as in Example 1 except that the compound represented by the formula (1-1) was not used in the preparation of the coating liquid for a surface layer.

Comparative Example 2

An electrophotographic photosensitive member was produced in the same manner as in Example 1 except that the compound represented by the formula (1-1) was changed to trimethylolpropane triacrylate (product name: KAYARAD TMPTA, manufactured by Nippon Kayaku Co., Ltd.) in the preparation of the coating liquid for a surface layer.

Comparative Example 3

An electrophotographic photosensitive member was produced in the same manner as in Example 1 except that the compound represented by the formula (1-1) was changed to caprolactone-modified dipentaerythritol hexaacrylate (product name: KAYARAD DPCA-120, manufactured by Nippon Kayaku Co., Ltd.) in the preparation of the coating liquid for a surface layer.

Comparative Example 4

An electrophotographic photosensitive member was produced in the same manner as in Example 1 except that the coating liquid for a surface layer was prepared as described below.

43 Parts of the hole-transportable compound represented by the formula (6-3), 21 parts of trimethylolpropane triacrylate (product name: KAYARAD TMPTA, manufactured by Nippon Kayaku Co., Ltd.), 21 parts of caprolactone-modified dipentaerythritol hexaacrylate (product name: KAYARAD DPCA-120, manufactured by Nippon Kayaku Co., Ltd.), 0.1 part of a mixture of acrylic group-containing polyester-modified polydimethylsiloxane and propoxy-modified 2-neopentyl glycol diacrylate (BYK-UV3570, manufactured by BYK-Chemie GmbH), 0.1 part of the compound represented by the formula (3-3), 4 parts of 1-hydroxycyclohexyl phenyl ketone (Irgacure 184, manufactured by Ciba Specialty Chemicals Inc.), and 100 parts of tetrahydrofuran were added to the α-alumina dispersion liquid (1), and the resultant mixture was filtered through a polyflon filter (product name: PF-040, manufactured by Advantec Toyo Kaisha, Ltd.) to prepare the coating liquid for a surface layer.

Comparative Example 5

An electrophotographic photosensitive member was produced in the same manner as in Example 17 except that the compound represented by the formula (1-1) was not used in the preparation of the coating liquid for a surface layer.

TABLE 1

| | Surface layer configuration | | | | |
|---|---|---|---|---|---|
| Example | Hole-transportable compound having chain-polymerizable functional group | Compound represented by formula (1) | Metal oxide particles | $M_\alpha/M_\beta$ | $M_\alpha/(M_\beta + M_\gamma)$ |
| Example 1 | Compound represented by formula (6-3) | Compound represented by formula (1-1) | α-Alumina | 4 | 0.8 |
| Example 2 | Compound represented by formula (6-1) | Compound represented by formula (1-1) | α-Alumina | 4 | 0.8 |
| Example 3 | Compound represented by formula (7) | Compound represented by formula (1-1) | α-Alumina | 4 | 0.8 |
| Example 4 | Compound represented by formula (6-3) | Compound represented by formula (1-1) | Surface-treated tin oxide | 4 | 0.8 |
| Example 5 | Compound represented by formula (6-3) | Compound represented by formula (1-1) | Titanium oxide | 4 | 0.8 |
| Example 6 | Compound represented by formula (6-3) | Compound represented by formula (1-3) | α-Alumina | 4 | 0.8 |
| Example 7 | Compound represented by formula (6-3) | Compound represented by formula (1-1) | α-Alumina | 2 | 0.4 |
| Example 8 | Compound represented by formula (6-3) | Compound represented by formula (1-1) | α-Alumina | 2 | 0.4 |
| Example 9 | Compound represented by formula (6-3) | Compound represented by formula (1-1) | α-Alumina | 1.2 | 0.3 |
| Example 10 | Compound represented by formula (6-3) | Compound represented by formula (1-1) | α-Alumina | 42 | 0.95 |
| Example 11 | Compound represented by formula (6-3) | Compound represented by formula (1-1) | α-Alumina | 0.8 | 0.2 |
| Example 12 | Compound represented by formula (6-3) | Compound represented by formula (1-1) | α-Alumina | 53 | 0.96 |
| Example 13 | Compound represented by formula (6-3) | Compound represented by formula (1-1) | α-Alumina | 0.4 | 0.09 |
| Example 14 | Compound represented by formula (6-3) | Compound represented by formula (1-1) | α-Alumina | 53 | 1.1 |
| Example 15 | Compound represented by formula (8) | Compound represented by formula (1-1) | α-Alumina | 4 | 0.8 |
| Example 16 | Compound represented by formula (9) | Compound represented by formula (1-1) | α-Alumina | 4 | 0.8 |
| Example 17 | Compound represented by formula (6-3) | Compound represented by formula (1-1) | α-Alumina | 4 | 0.8 |
| Example 18 | Compound represented by formula (6-3) | Compound represented by formula (1-1) | α-Alumina | 4 | 0.8 |
| Example 19 | Compound represented by formula (6-3) | Compound represented by formula (1-5) | α-Alumina | 4 | 0.8 |
| Example 20 | Compound represented by formula (6-3) | Compound represented by formula (1-6) | α-Alumina | 4 | 0.8 |
| Example 21 | Compound represented by formula (6-3) | Compound represented by formula (1-6) | α-Alumina | 4 | 0.8 |
| Example 22 | Compound represented by formula (6-3) | Compound represented by formula (1-6) | α-Alumina | 4 | 0.8 |
| Example 23 | Compound represented by formula (8) | Compound represented by formula (1-6) | α-Alumina | 4 | 0.8 |
| Example 24 | Compound represented by formula (8) | Compound represented by formula (1-6) | α-Alumina | 0.4 | 0.09 |
| Example 25 | Compound represented by formula (8) | Compound represented by formula (1-6) | α-Alumina | 53 | 1.1 |
| Comparative Example 1 | Compound represented by formula (6-3) | None | α-Alumina | 0 | 0.0 |
| Comparative Example 2 | Compound represented by formula (6-3) | None | α-Alumina | 0 | 0.0 |
| Comparative Example 3 | Compound represented by formula (6-3) | None | α-Alumina | 0 | 0.0 |
| Comparative Example 4 | Compound represented by formula (6-3) | None | α-Alumina | 0 | 0.0 |
| Comparative Example 5 | Compound represented by formula (6-3) | None | α-Alumina | 0 | 0.0 |

Evaluation of Electrophotographic Photosensitive Member

The produced electrophotographic photosensitive members were each mounted onto an evaluation apparatus described below and subjected to an evaluation described below.

Evaluation Apparatus

The electrophotographic photosensitive members produced in Examples 1 to 25 and Comparative Examples 1 to 5 were each evaluated by being mounted onto a reconstructed machine of a copying machine imageRUNNER(iR) (trademark)-ADV C5051 manufactured by Canon Inc. (including: a charging unit of a system configured to apply a voltage obtained by superimposing an AC voltage on a DC voltage to a roller-type contact charging member (charging roller); and an exposing unit of a laser image exposure system (wavelength: 780 nm)).

Specifically, the evaluation was performed under the following state: the evaluation apparatus was placed under each of an environment having a temperature of 23° C. and a humidity of 50% RH and an environment having a temperature of 30° C. and a humidity of 85% RH, and each produced electrophotographic photosensitive member was mounted onto a process cartridge for a cyan color, which was mounted onto a station for the cyan process cartridge.

With regard to charging conditions, an AC component to be applied to the charging roller was set to a peak-to-peak voltage of 1,300 V and a frequency of 1,300 Hz, and a DC component (initial dark portion potential (Vda)) was set to −700 V. In addition, with regard to exposure conditions, the exposure conditions were adjusted so that an initial light portion potential (Vla) before repeated use in the case of irradiation with laser exposure light was −200 V.

The surface potential of the electrophotographic photosensitive member was measured by removing a cartridge for development from the evaluation apparatus and inserting a potential measurement apparatus thereinto. The potential measurement apparatus was configured by placing a potential measurement probe (product name: model 6000B-8, manufactured by Trek Japan) at the development position of the cartridge for development, and the position of the potential measurement probe with respect to the electrophotographic photosensitive member was set to have a gap of 3 mm from the surface of the electrophotographic photosensitive member at the center in the generating-line direction of the electrophotographic photosensitive member. Further, a potential at the central portion of the electrophotographic photosensitive member was measured with a surface potentiometer (product name: model 344, manufactured by Trek Japan).

Evaluation of Potential Fluctuation at Time of Repeated Use

The cartridge for development mounted with the electrophotographic photosensitive member was mounted onto the evaluation apparatus, and repeated use of the photosensitive member was performed passing 100,000 sheets of paper. Repeated image formation of a letter image having a print percentage of 1% on 100,000 sheets was performed with the cyan color alone using A4 size plain paper. An initial dark portion potential in this case and a dark portion potential after the repeated image formation on 100,000 sheets are compared, and a difference therebetween is defined as a potential fluctuation value (ΔVd). In addition, the initial light portion potential and a light portion potential after the repeated image formation on 100,000 sheets are compared, and a difference therebetween is defined as a potential fluctuation value (ΔV1). After the completion of the passing of 100,000 sheets of paper, the whole was left to stand for 5 minutes, and the cartridge for development was replaced with the potential measurement apparatus, followed by the measurement of the light portion potential (Vlb) and dark portion potential (Vdb) after repeated use. The difference between the dark portion potential after the repeated use and the initial dark portion potential (Vda) was determined as a dark portion potential fluctuation amount ($\Delta Vd=|Vdb|-|Vda|$), the difference between the light portion potential after the repeated use and the initial light portion potential (Vla) was determined as a light portion potential fluctuation amount ($\Delta Vl=|Vlb|-|Vla|$), and evaluation was performed in accordance with the following evaluation ranks. In the present disclosure, it was judged that Ranks A, B, C, and D were each a level at which the effect of the present disclosure was obtained, and of those, Rank A was an excellent level. Meanwhile, Rank E was judged to be a level at which the effect of the present disclosure was not obtained.

A: The change in each of light portion potential and dark portion potential is 5 V or less.

B: The change in each of light portion potential and dark portion potential is more than 5 V and 10 V or less.

C: The change in each of light portion potential and dark portion potential is more than 10 V and 20 V or less.

D: The change in each of light portion potential and dark portion potential is more than 20 V and 30 V or less.

E: The change in each of light portion potential and dark portion potential is more than 30 V.

The results of the evaluation performed as described above with the evaluation apparatus are shown in Table 2.

TABLE 2

| | Evaluation result | | | |
|---|---|---|---|---|
| | 23° C., 50% RH | | 30° C., 85% RH | |
| Example | ΔVd | ΔVl | ΔVd | ΔVl |
| Example 1 | A | A | A | A |
| Example 2 | A | A | A | A |
| Example 3 | A | A | A | A |
| Example 4 | A | A | A | A |
| Example 5 | A | A | A | A |
| Example 6 | A | A | A | A |
| Example 7 | A | A | A | A |
| Example 8 | A | A | A | A |
| Example 9 | A | A | A | A |
| Example 10 | A | A | A | A |
| Example 11 | B | C | C | C |
| Example 12 | B | C | C | C |
| Example 13 | C | C | C | C |
| Example 14 | C | C | C | C |
| Example 15 | B | B | B | C |
| Example 16 | B | B | B | C |
| Example 17 | B | B | B | C |
| Example 18 | B | B | B | C |
| Example 19 | B | B | B | C |
| Example 20 | B | B | B | C |
| Example 21 | B | C | C | C |
| Example 22 | B | C | C | C |
| Example 23 | B | B | C | C |
| Example 24 | C | C | C | C |
| Example 25 | C | C | C | C |
| Comparative Example 1 | C | D | E | E |
| Comparative Example 2 | C | C | D | E |

TABLE 2-continued

| | Evaluation result | | | |
|---|---|---|---|---|
| | 23° C., 50% RH | | 30° C., 85% RH | |
| Example | ΔVd | ΔVl | ΔVd | ΔVl |
| Comparative Example 3 | C | C | D | E |
| Comparative Example 4 | C | C | D | E |
| Comparative Example 5 | D | D | E | E |

As shown in Table 2, it is found that the electrophotographic photosensitive member according to at least one embodiment of the present disclosure, and the process cartridge and the electrophotographic apparatus each using the electrophotographic photosensitive member according to at least one embodiment of the present disclosure provide satisfactory results regarding potential fluctuation at the time of long-term repeated use irrespective of the environment. It is found that, when the surface layer is free of the compound represented by the formula (1) as in Comparative Examples, the potential fluctuation increases, and hence the objects of the present disclosure cannot be achieved.

As described above by way of embodiments and Examples, according to at least one embodiment of the present disclosure, the electrophotographic photosensitive member including a surface layer suppressed in potential fluctuation at the time of long-term repeated use irrespective of an environment can be provided. In addition, according to at least one embodiment of the present disclosure, the process cartridge and the electrophotographic apparatus each including the electrophotographic photosensitive member can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-001948, filed Jan. 9, 2019, which is hereby incorporated by reference herein in its entirety.

What is claimed is:

1. An electrophotographic photosensitive member comprising, in this order:

an electro-conductive support;

a photosensitive layer; and a surface layer, the surface layer comprising metal oxide particles, and a copolymerization product of a composition containing a hole-transportable compound having a chain-polymerizable functional group and a compound represented by formula (1)

(1)

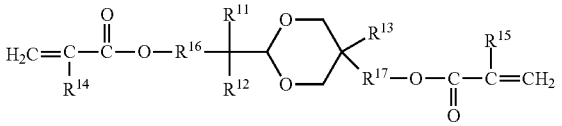

where $R^{11}$ and $R^{12}$ independently represent an alkyl group having 1 to 4 carbon atoms with the proviso that $R^{11}$ and $R^{12}$ may be bonded to each other to form a ring, $R^{13}$ represents an alkyl group having 1 to 4 carbon atoms, $R^{14}$ and $R^{15}$ independently represent a hydrogen atom or a methyl group, and $R^{16}$ and $R^{17}$ independently represent an alkylene group having 1 to 4 carbon atoms.

2. The electrophotographic photosensitive member according to claim 1, wherein $1 \leq M_\alpha/M_\beta \leq 45$ when $M_\alpha$ is a content of the compound represented by formula (1) in the surface layer and $M_\beta$ is a content of the metal oxide particles in the surface layer.

3. The electrophotographic photosensitive member according to claim 2, wherein $0.1 \leq M_\alpha/(M_\beta+M_\gamma) \leq 1.0$ when $M_\gamma$ is a content of the hole-transportable compound having a chain-polymerizable functional group in the surface layer.

4. The electrophotographic photosensitive member according to claim 1, wherein the hole-transportable compound has one chain-polymerizable functional group.

5. The electrophotographic photosensitive member according to claim 1, wherein the photosensitive layer contains a compound represented by formula (2)

(2)

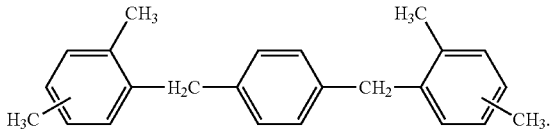

6. The electrophotographic photosensitive member according to claim 1, wherein the composition further contains a compound represented by formula (3)

(3)

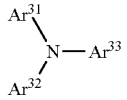

where $Ar^{31}$ to $Ar^{33}$ independently represent a substituted or unsubstituted phenyl group or a substituted or unsubstituted biphenyl group, with the proviso that at least one of $Ar^{31}$ to $Ar^{33}$ represents a substituted or unsubstituted biphenyl group, at least one of $Ar^{31}$ to $Ar^{33}$ has a group represented by formula (4), and a substituent of each of the substituted phenyl group and the substituted biphenyl group is independently an alkyl group, an alkoxy group, a group represented by formula (4), or a group represented by formula (5)

(4)

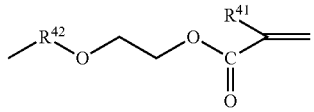

(5)

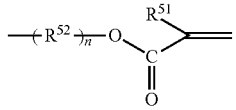

where $R^{41}$ represents a hydrogen atom or a methyl group, $R^{42}$ represents an alkylene group having 1 to 6 carbon atoms, R represents a hydrogen atom or a methyl group, $R^{52}$ represents an alkylene group having 1 to 6 carbon atoms, and n represents 0 or 1.

7. The electrophotographic photosensitive member according to claim 1, wherein $R^{11}$ and $R^{12}$ each represent a methyl group.

8. A process cartridge, comprising:

an electrophotographic photosensitive member, and at least one unit selected from the group consisting of a charging unit, a developing unit, and a cleaning unit;

the process cartridge integrally supporting the electrophotographic photosensitive member and the at least one unit, and being removably mounted onto a main body of an electrophotographic apparatus; and the electrophotographic photosensitive member comprising an electrophotographic photosensitive member including, in this order:

an electro-conductive support;

a photosensitive layer; and a surface layer, the surface layer comprising metal oxide particles, and a copolymerization product of a composition containing a hole-transportable compound having a chain-polymerizable functional group and a compound represented by formula (1)

(1)

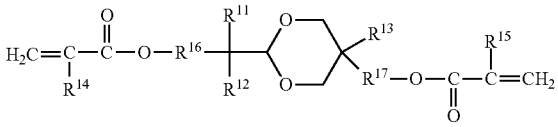

where $R^{11}$ and $R^{12}$ independently represent an alkyl group having 1 to 4 carbon atoms with the proviso that $R^{11}$ and $R^{12}$ may be bonded to each other to form a ring, $R^{13}$ represents an alkyl group having 1 to 4 carbon atoms, $R^{14}$ and $R^{15}$ independently represent a hydrogen atom or a methyl group, and $R^{16}$ and $R^{17}$ independently represent an alkylene group having 1 to 4 carbon atoms.

9. An electrophotographic apparatus comprising:

an electrophotographic photosensitive member; and at least one unit selected from the group consisting of a charging unit, an exposing unit, a developing unit, and a transferring unit;

the electrophotographic photosensitive member comprising an electrophotographic photosensitive member including, in this order:

an electro-conductive support;

a photosensitive layer; and a surface layer, the surface layer comprising metal oxide particles, and a copolymerization product of a composition containing a hole-transportable compound having a chain-polymerizable functional group and a compound represented by formula (1)

(1)

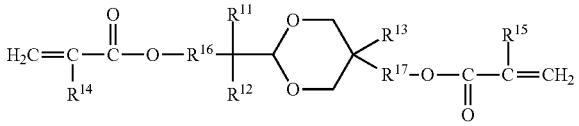

where $R^{11}$ and $R^{12}$ independently represent an alkyl group having 1 to 4 carbon atoms with the proviso that $R^{11}$ and $R^{12}$ may be bonded to each other to form a ring, $R^{13}$ represents an alkyl group having 1 to 4 carbon atoms, $R^{14}$ and $R^{15}$ independently represent a hydrogen atom or a methyl group, and $R^{16}$ and $R^{17}$ independently represent an alkylene group having 1 to 4 carbon atoms.

* * * * *